US007033272B1

(12) United States Patent
Mason

(10) Patent No.: US 7,033,272 B1
(45) Date of Patent: Apr. 25, 2006

(54) METHOD FOR IMPLEMENTING A SECONDARY GAME IN A GAMING MACHINE

(75) Inventor: Shannon Mason, Las Vegas, NV (US)

(73) Assignee: Acres Gaming Incorporated, Las Vegas, NV (US)

( * ) Notice: Subject to any disclaimer, the term of this patent is extended or adjusted under 35 U.S.C. 154(b) by 421 days.

(21) Appl. No.: 10/120,213

(22) Filed: Apr. 9, 2002

Related U.S. Application Data

(60) Provisional application No. 60/282,813, filed on Apr. 9, 2001.

(51) Int. Cl.
*A63F 9/24* (2006.01)

(52) U.S. Cl. ..... 463/25

(58) Field of Classification Search ..... 463/16–22, 463/25–28

See application file for complete search history.

(56) References Cited

U.S. PATENT DOCUMENTS

| | | | | |
|---|---|---|---|---|
| 4,837,728 | A | 6/1989 | Barrie et al. | |
| 5,655,961 | A | 8/1997 | Acres et al. | |
| 5,788,573 | A | 8/1998 | Baerlocher et al. | |
| 5,823,874 | A | 10/1998 | Adams | |
| 5,848,932 | A | 12/1998 | Adams | |
| 6,033,307 | A | 3/2000 | Vancura | |
| 6,159,098 | A | 12/2000 | Slomiany et al. | |
| 6,190,255 | B1 | 2/2001 | Thomas et al. | |
| 6,203,429 | B1 | 3/2001 | Demar et al. | |
| 6,319,125 | B1 | 11/2001 | Acres | |
| 6,406,369 | B1 * | 6/2002 | Baerlocher et al. | 463/20 |
| 6,439,995 | B1 * | 8/2002 | Hughs-Baird et al. | 463/20 |
| 6,514,141 | B1 * | 2/2003 | Kaminkow et al. | 463/25 |
| 6,609,972 | B1 * | 8/2003 | Seelig et al. | 463/16 |
| 6,634,943 | B1 * | 10/2003 | Baerlocher | 463/25 |

(Continued)

FOREIGN PATENT DOCUMENTS

| | | |
|---|---|---|
| AU | A-45402/97 | 5/1998 |

(Continued)

OTHER PUBLICATIONS

"Press Your Luck", Nov. 18, 2005, Wikipedia, http://en-.wikipedia.org/wiki/Press_Your_Luck.*

*Primary Examiner*—Xuan M. Thai
*Assistant Examiner*—Sean Sprigg
(74) *Attorney, Agent, or Firm*—Marger Johnson & McCollom,PC

(57) ABSTRACT

In operation, when a special symbol appears on one of the base-game reels, the secondary game is initiated. The game incorporates a scripted bonus, meaning once the initiator symbol is hit then one of fifty scripts is selected that take the player through the predetermined bonus sequence on the top box. Each script includes multiple steps and requires player interaction in order to advance to the next step in the sequence. The top box includes a diamond playing field with twelve different bonus spots, eight showing numerical values between 5 and 500, one "Lose ½" spot, one "Double" spot, a "PayTime" spot, and a "Triple PayTime" spot. In a first embodiment of the invention, each time the player hits the spin button, the spots are flashed sequentially around the diamond with the flash rate eventually slowing down to heighten the anticipation ("spin with anticipation"), eventually coming to a stop to alight on the spot preselected by the bonus controller electronics. In a second embodiment of the game, the bonus spots are flashed randomly until the player hits the quick pick button at which point the preselected bonus spot is lit.

17 Claims, 5 Drawing Sheets

U.S. PATENT DOCUMENTS

| | | | | |
|---|---|---|---|---|
| 2002/0045474 | A1* | 4/2002 | Singer et al. | 463/20 |
| 2002/0077170 | A1* | 6/2002 | Johnson et al. | 463/16 |
| 2002/0198044 | A1* | 12/2002 | Walker et al. | 463/25 |
| 2003/0176216 | A1* | 9/2003 | Storey | 463/25 |

FOREIGN PATENT DOCUMENTS

| | | | |
|---|---|---|---|
| AU | A-48324/97 | | 6/1998 |
| EP | 000945837 | A2 * | 9/1999 |

* cited by examiner

METHOD FOR IMPLEMENTING A SECONDARY GAME IN A GAMING MACHINE

CROSS-REFERENCES TO RELATED APPLICATIONS

This application claims the benefit from U.S. Provisional Patent Application No. 60/282,813 filed Apr. 9, 2001 whose contents are incorporated herein for all purposes.

BACKGROUND OF THE INVENTION

1. Field of the Invention

This invention relates generally to electronic gaming machines and more particularly to a method and apparatus for integrating a primary and secondary game within a computer network.

2. Description of the Prior Art

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine and stored in the gaming machine's programmable read-on memory (PROM).

Competition for players among electronic gaming machines is tight and the industry is developing different methods for attracting and keeping players at their machines. One method for attracting players is to create linked progressive jackpot systems in which multiple gaming machines have been linked together into groups of machines that share the same bonus pool. A simple example of such a system is progressive video poker in which players play the primary poker game on one of a plurality of gaming machines grouped together on the casino floor. A coin-in counter, linked to all machines sharing the progressive pool, counts the total amount of money played in the group of machines and advances the progressive bonus pool accordingly. For instance, the casino can choose to set aside 5% of all money played on the group of video poker machines to the bonus pool. The amount of the pool is displayed on a large LED display and is incremented as money is played. This amount is awarded automatically as a bonus should a player on one of the video poker machines receive a designated winning hand such as a royal flush. After the bonus is awarded, the bonus pool is seeded with a nominal amount that is further incremented as described above.

The advantage of the progressive system is that the bonus pools from individual machines can be pooled to form larger awards that in turn attract more players. When taken to the extreme, progressive bonuses can be pooled together not only from machines in different areas of the casino, but also from different casinos in different states. More complex examples for bonusing are implemented using bonus servers over a network, such as disclosed in co-owned U.S. Pat. No. 6,319,125 (the '125 patent), which is incorporated herein by reference for all purposes. Also incorporated herein by reference for all purposes is U.S. Pat. No. 5,655,961, assigned to the Assignee of the present application (the '961 patent), which also discloses bonuses that can be implemented by bonus servers over a network.

While these linked progressive systems have been effective at drawing additional players, there is a need for gaming machines that have additional attraction features and yet are not required to be linked to other machines.

SUMMARY OF THE INVENTION

The current invention is intended to provide a novel secondary game feature that can be played in addition to the base primary game. The preferred embodiment is described in association with a slot machine, although it is understood that any base game can be used.

In operation, when a special symbol appears on one of the base-game reels, the secondary game is initiated. The game incorporates a scripted bonus, meaning once the initiator symbol is hit then one of fifty scripts is selected that take the player through the predetermined bonus sequence on the top box. The top box includes a diamond playing field with twelve different bonus spots, eight showing numerical values between 5 and 500, one "Lose ½" spot, one "Double" spot, a "PayTime" spot, and a "Triple PayTime" spot.

In a first embodiment of the invention, each time the player hits the spin button, the spots are flashed sequentially around the diamond with the flash rate eventually slowing down to heighten the anticipation ("spin with anticipation"), eventually coming to a stop to alight on the spot preselected by the bonus controller electronics. If a numerical value is hit, then that amount is accumulated in the VFD and the player spins again. The "Double" spot doubles the amount in the VFD and the "Lose ½" cuts the accumulated bonus in half. The player accumulates awards until either the PayTime or Triple PayTime spot is hit, at which point the accumulated amount shown in the VFD (or triple that amount) is paid out to the player's credit meter.

In a second embodiment of the game, the bonus spots are flashed randomly until the player hits the quick pick button at which point the preselected bonus spot is lit. If the lit spot is a numerical value, then that amount is accumulated in the bonus award display and the player spins again. The "Double" spot doubles the amount in the VFD and the "Lose ½" cuts the accumulated bonus in half. The player accumulates awards until either the PayTime or Triple PayTime spot is hit, at which point the accumulated amount shown in the VFD (or triple that amount) is paid out to the player's credit meter.

The foregoing and other objects, features and advantages of the invention will become more readily apparent from the following detailed description of a preferred embodiment of the invention that proceeds with reference to the accompanying drawings.

DETAILED DESCRIPTION

Although the gaming machine as described is coupled to a gaming machine network, it is understood that the gaming machine can stand alone whereby the top box secondary game is completely funded by coins or credits played within the primary game. For instance, the secondary game may be funded and thus active only when a maximum bet is made. Alternately, the secondary game may be funded in different amounts by each of the coins or credits played at the base game.

Figure 1:
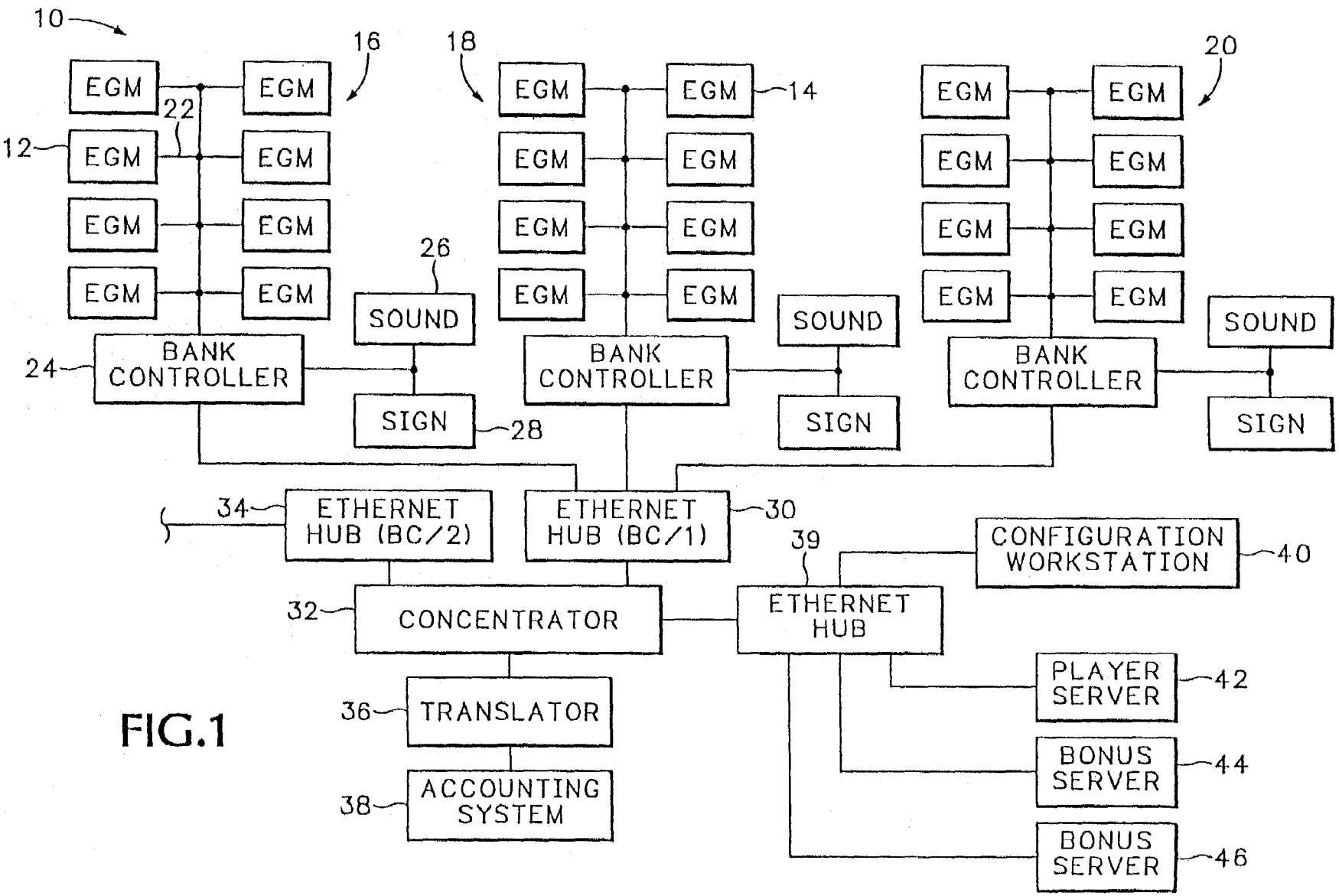
FIG. 1 is a schematic diagram of a plurality of electronic gaming machines interconnected by a computer network to a host computer in accordance with a networked embodiment of the present invention.

Turning now to FIG. 1, indicated generally at 10 is a schematic diagram illustrating electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a personal computer including a keyboard, Intel Pentium Processor, and Ethernet card. It is the primary user interface with the network.

The player server 42 comprises a microcomputer that is used to control messages that appear on displays associated with each EGM. Player server 42 includes an Intel Pentium Processor and an Ethernet card.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses that can be implemented on the network are disclosed in a co-pending application, now co-owned U.S. Pat. No. 6,319,125 (the '125 patent), which is incorporated herein by reference for all purposes. This co-pending patent also describes in more detail features of the network, like that shown in FIG. 1, that may be used to implement the present invention. The '961 patent also discloses bonuses that can be implemented by bonus servers 44, 46 and a network that could be used to implement the present invention.

As used herein the term jackpot indicates an award made resulting from the pay table on one of the EGMs while the term bonus indicates an award that does not result from the machine's pay table. The '125 patent and '961 patent include many examples of bonuses. The term award is intended to encompass any payment given to a player of one of the EGM's and includes both jackpots and bonuses.

Figure 2:
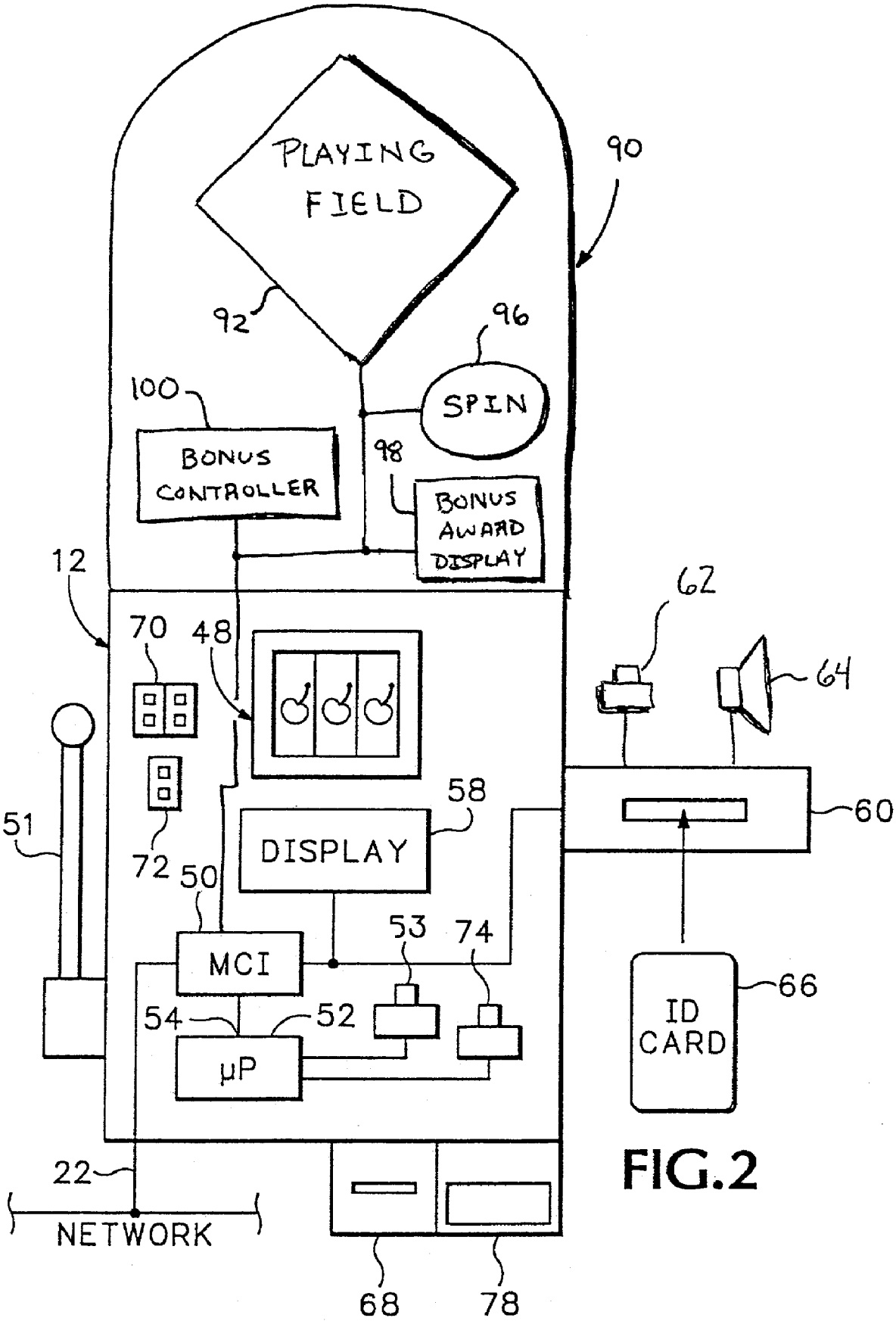
FIG. 2 is a schematic diagram of a slot machine and associated hardware, including the top box secondary game constructed in accordance with a preferred embodiment of the invention.

FIG. 2 illustrates a gaming machine 12 constructed according to a preferred embodiment of the invention. Included is a highly schematic representation of an electronic slot machine—typical of each of the machines in the network—that incorporates network communications hardware as described hereinafter. This hardware is described in the '961 patent, and is referred to therein as a data communications node. Preferably the network communications hardware is like that disclosed in the '125 patent, namely a machine communication interface (MCI) 50.

MCI 50 facilitates communication between the network, via connection 22, and microprocessor 52, which controls the operation of EGM 12. This communication occurs via a serial port 54 on the microprocessor to which MCI 50 is connected.

Included in EGM 12 are three reels, indicated generally at 48. Each reel includes a plurality of different symbols thereon. The reels spin in response to a pull on handle 51 or actuation of a spin button 53 after a wager is made. One or all of the reels 48 may include a special bonus initiator symbol which, when obtained on the gaming machine's payline, will cause the MCI 50 to initiate the secondary bonus game, which is operated according to methods discussed further below.

MCI 50 includes a random access memory (RAM), which can be used as later described herein. The MCI also facilitates communication between the network and a vacuum florescent display (VFD) 58, a card reader 60, a player-actuated push button 62, and a speaker 64.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor 80 (FIG. 3) that may also be used by the player to make a wager. A credit meter 70 is a numeric display that indicates the total number of credits available for the player to wager. The credits are in the base denomination of the machine. For example, in a nickel slot machine, when a five-dollar bill is inserted into bill acceptor 68, a credit of 100 appears on credit meter 70. To place a wager, the player depresses a coin-in button 82 (FIG. 3), which transfers a credit from the credit meter 70 to a coin-in meter 72. Each time the button is depressed a single credit transfers to the coin-in meter up to a maximum bet that can be placed on a single play of the machine. In addition, a maximum-bet button 84 (FIG. 3) may be provided to immediately transfer the maximum number of credits that can be wagered on a single play from the credit meter 70 to the coin-in meter 72.

When coin-in meter 72 reflects the number of credits that the player intends to wager, the player depresses spin button 53 thereby initiating the base game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '125 patent. Briefly summarizing such a system, a player registers with the casino prior to commencing gaming. The casino issues a unique player-tracking card to the player and opens a corresponding player account that is stored on accounting system 38 (in FIG. 1). Accounting system 38 is referred to herein as a host computer. It should be appreciated, however, that the host computer can be distributed on the network and could include multiple processors or memories. The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

To induce the player to use the card, the casino awards each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

The electronic gaming machine 12 constructed according to a preferred embodiment of the invention includes a Bally S5500/S6000 upright slot machine, which is the base game, with the top box removed. The top box is replaced with a top box 90 customized to implement a secondary, bonus game according the present invention. The top box 90 includes a display playing field 92, a paytable display 94 (FIG. 3) for the primary base game, a bonus game spin button 96, and a vacuum fluorescent bonus award display 98 intended to display the bonus credits accumulated by playing the secondary bonus game. The top box also includes a bonus and light controller 100 that interfaces with MCI 50 to drive the light display pattern of the top box 90 in attract mode and bonus play mode.

Figure 3:
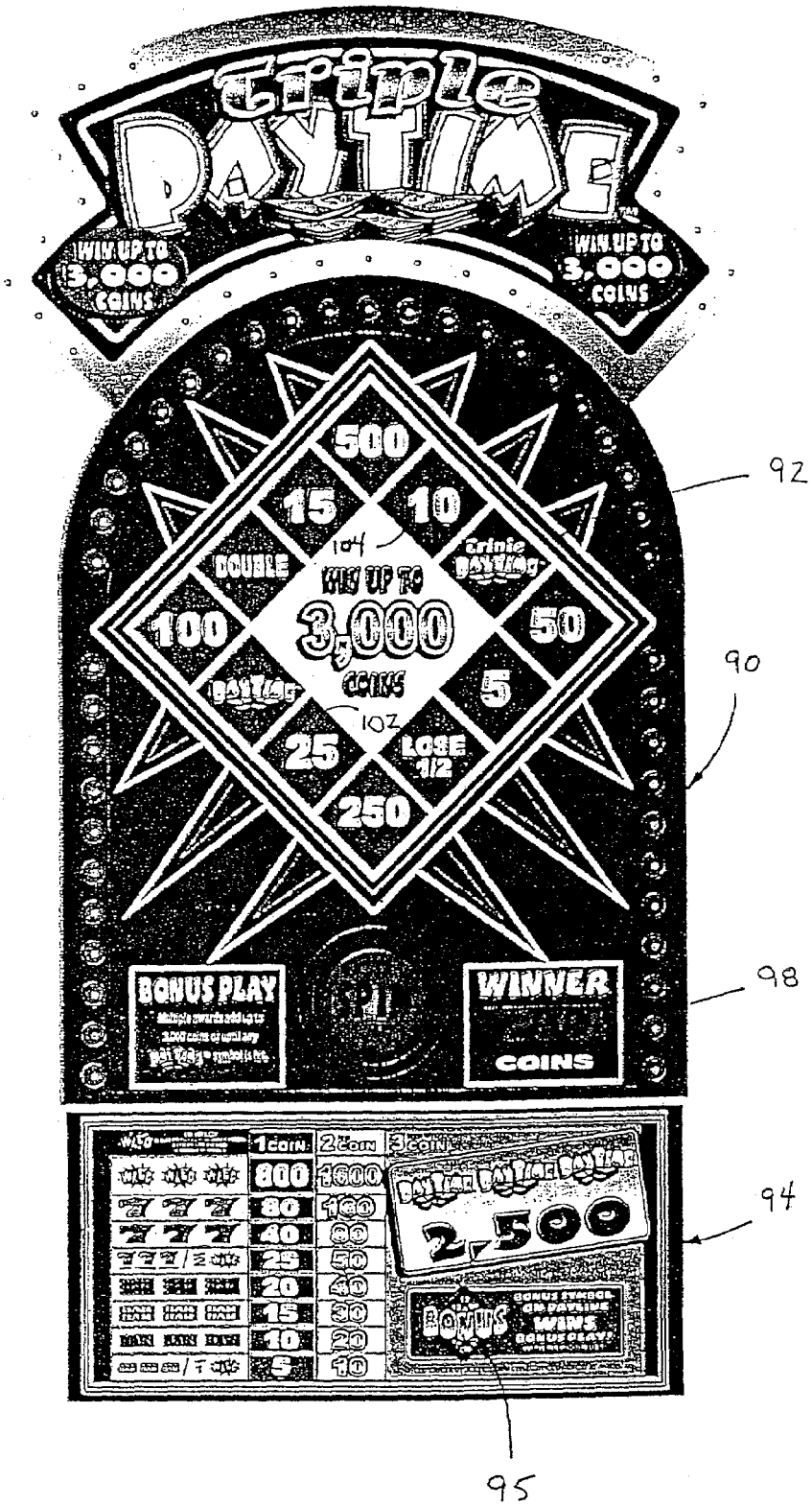
FIG. 3 is a pictorial view of the top box playing field displaying the secondary game implemented using the apparatus shown in FIG. 2.

A more pictorial view of the electronic gaming machine 12 with top box 90 is shown in FIG. 3. The playing field 92 includes twelve predesignated positions arranged in a diamond pattern, such as bonus spots 102, 104, each having a numerical value, a math function or a paytime/triple paytime event associated with it. Each of the spaces light up in a sequence determined by the bonus controller until the sequence stops and one of the twelve predesignated positions remains lit.

The bonus game includes a bonus controller, which initiates a randomly selected one of about fifty scripted sequences to indicate a possible bonus award spot on a light board (over and above the pay table on the base game) when the bonus game is played. The bonus controller 100 includes:

- a central processing unit (CPU);
- a vacuum fluorescent display (VFD) 98;
- a spin button 96 to start the light sequence through the bonus award spots;
- a random number generator (RNG), which determines the bonus game outcome, i.e., the sequence of bonus award spot obtained; and
- firmware for controlling sound generation, the VFD, and the interface that initiates the bonus game.

The MCI 50 facilitates communication between the base game and the bonus controller 100.

Figure 4:
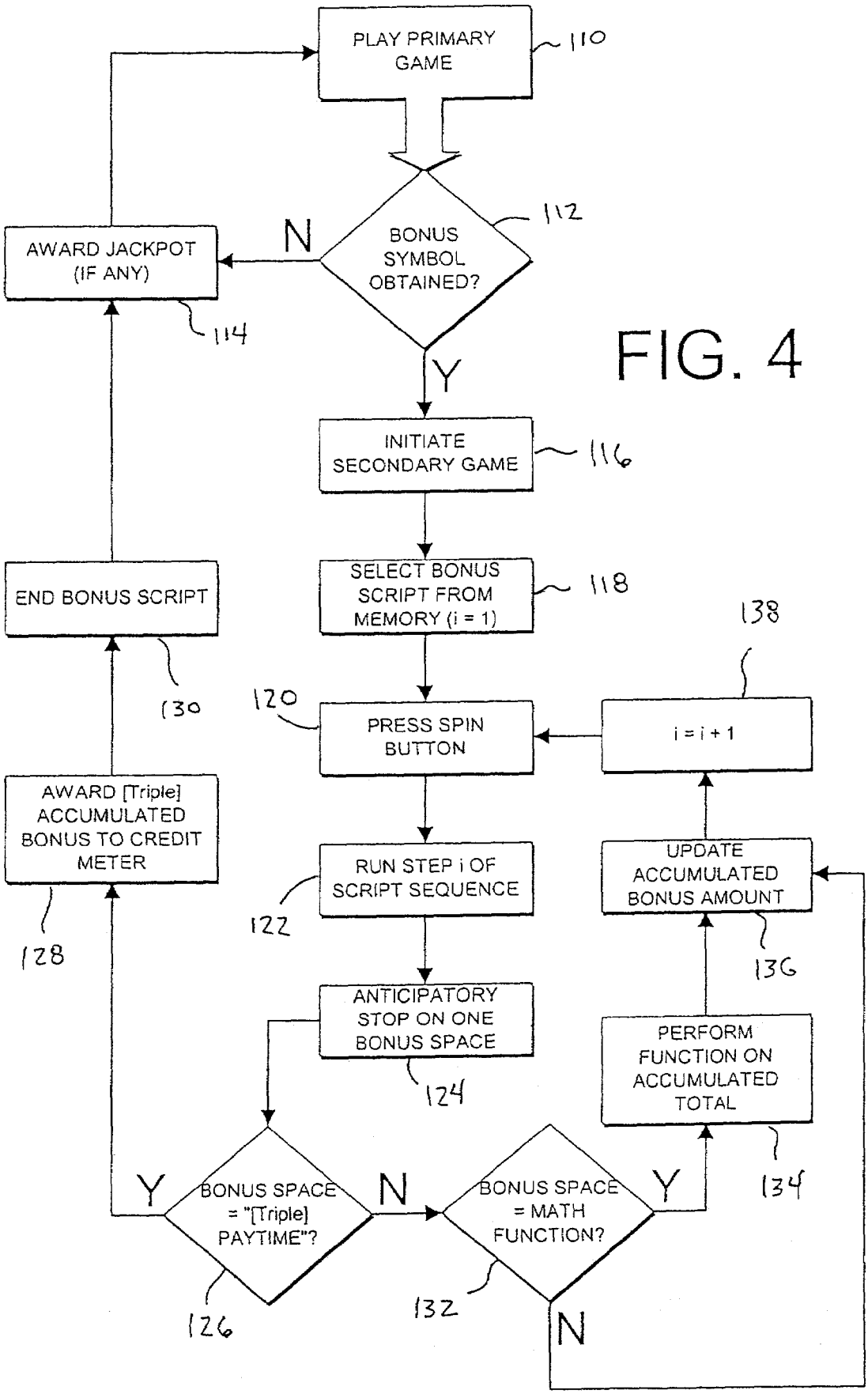
FIG. 4 is a flow chart that depicts the operation of the FIG. 3 secondary game in accordance with a first embodiment of the present invention.

The PayTime secondary game is implemented as shown in FIG. 4, according to a preferred embodiment of the invention. In operation, the player plays the base game in block 110 and is paid in block 114 according to the pay table 94 in that game. The base game has three reels 48, which—in each game-stop according to a random number generated for each reel. One of the reels includes an initiator symbol 95 (FIG. 3). The bonus controller 100 detects if that reel stops on the symbol in block 112. If it does, the bonus controller 100 initiates the bonus game in block 116 and delays the end of the base game. If no bonus symbol 95 is obtained on any one of the reels 48, then the game proceeds to block 114 and the jackpot award from symbols corresponding to paytable 94 payouts (if any) are awarded to the players credit meter 70 (FIG. 2).

The game incorporates a scripted bonus, meaning once the initiator symbol is hit then one of fifty scripts is selected in block 118 that take the player through the predetermined bonus sequence on the top box. Each script includes multiple steps and requires player interaction in order to advance to the next step in the sequence. The top box 90 according to this first embodiment of the invention, called "Triple Paytime", includes a diamond playing field with twelve different bonus spots, eight showing numerical values between 5 and 500, one "Lose ½" spot, one "Double" spot, a "PayTime" spot, and a "Triple PayTime" spot. Each time the player hits the spin button in block 120, the spots are flashed sequentially in block 122 around the diamond with the flash rate eventually slowing down to heighten the anticipation ("spin with anticipation"), eventually coming to a stop in block 124 to alight on the spot preselected by the bonus controller electronics 100. If a numerical value is hit, then that amount is accumulated in the VFD and the player spins again. The "Double" spot doubles the amount in the VFD and the "Lose ½" cuts the accumulated bonus in half. The player accumulates awards until either the PayTime or Triple PayTime spot is hit, at which point the accumulated amount shown in the VFD (or triple that amount) is paid out to the player's credit meter.

In query 126, it is determined whether the bonus space selected during the initial step in the scripted sequence is a "Paytime" space. If so, then the sequence progresses to block 128 in which the bonus award accumulated in the bonus display 98 is credited to the credit meter 70. The script then ends in block 130 and any jackpot award from the primary game is awarded in block 114. Play of the primary game then continues in block 110 until a bonus symbol is again obtained. A "Triple Paytime" result in query 126 during the bonus game also causes the sequence to move to block 128, except that the amount in the bonus display 98 is tripled before awarding the amount to credit meter 70.

If a "Paytime" or "Triple Paytime" result is not obtained in the current step of the script sequence, then the method proceeds to query block 132 in which it is determined whether a math function (e.g. "Double", "Lose ½", etc) is obtained. If a math function is selected, play proceeds to block 134 in which the math function is applied to the total accumulated within the bonus display 98. Seed values can be initially given upon the start of the bonus sequence so that a math value obtained during the first step of the bonus sequence would result in some affect to the accumulated bonus total. If no "Paytime" or math function is obtained, then play proceeds to block 136 in which the bonus space value selected is accumulated in the bonus display. The sequence then proceeds to block 138 in which the sequence step number is advanced by one, the spin button 96 is enabled and the gaming machine again waits for activation of the spin button by the player in step 120 before proceeding with the next step of the bonus sequence.

In one play sequence, for example, the player hits the initiator symbol and the bonus sequence script is selected whereby the following sequence occurs: player hits the 15 spot, player hits the 5 spot, player hits the "Double" spot and player hits the "Triple Playtime" spot thus resulting in a total bonus award from four spins of 120 credits. Since each sequence is scripted and the script is selected at the beginning of the bonus game, the end bonus result is predesignated and player interaction only moves the bonus sequence to the next step in the sequence.

Quick Pick Paytime

Figure 5:
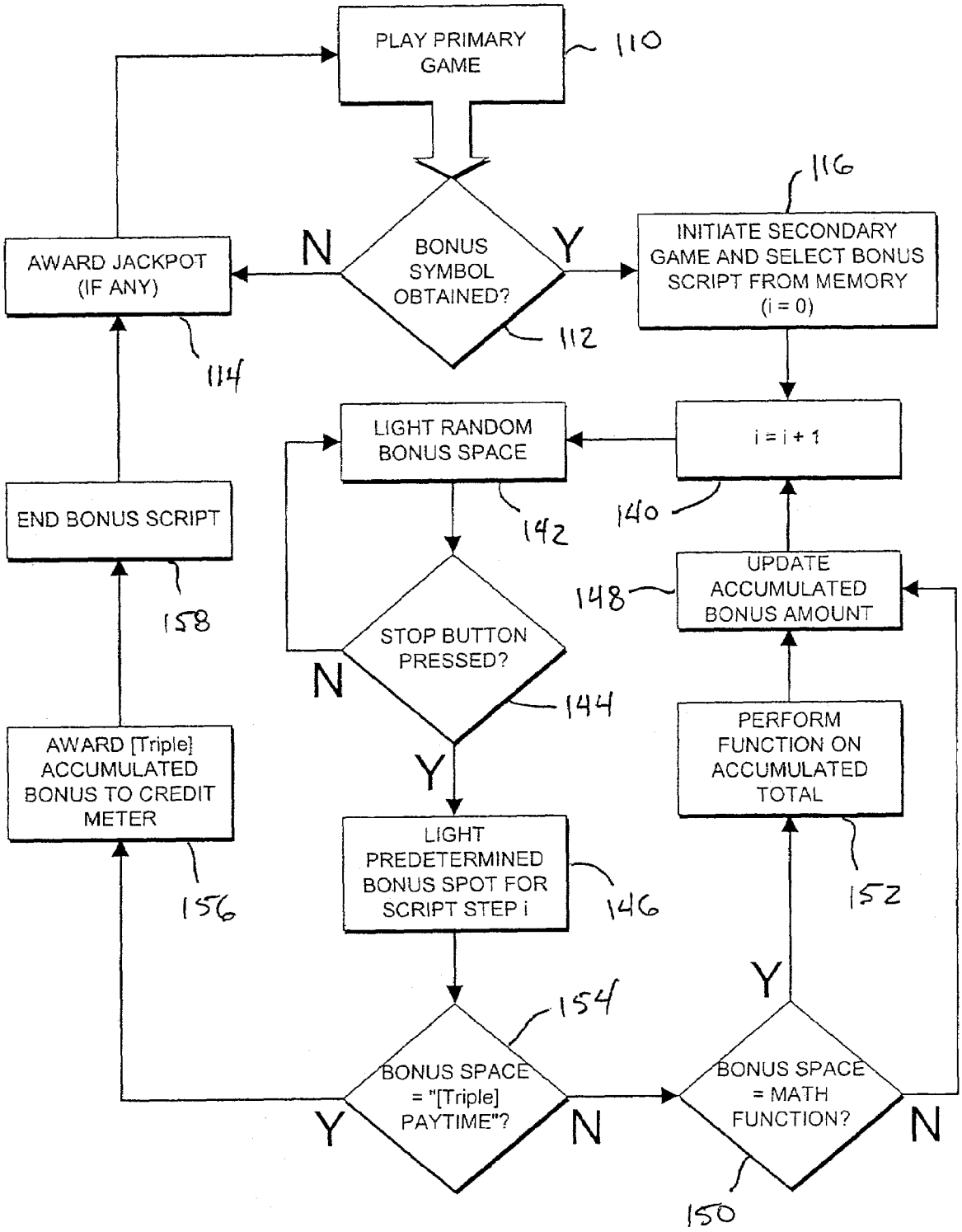
FIG. 5 is a flow chart that depicts the operation of the FIG. 3 secondary game in accordance with a second embodiment of the present invention.

Quick Pick PlayTime is nearly identical to Triple PlayTime except that the player presses a "Quick Pick" button to stop the random flashing of bonus spots instead of pressing the spin button to start the process of random flashing. The player is given the illusion of having control over the selection of the bonus spot. ("pseudo skill stop") In reality, the bonus spot sequence is preselected. FIG. 5 is a flow diagram illustrating the operation of a secondary bonus game, called "Quick Pick Paytime", according to a preferred embodiment of the invention. A quick pick button activation detector causes the flasher to light up the preselected bonus spot as the next spot in the sequence. Because the spots are flashed so quickly, the player is given the illusion that they stopped the selector themselves. Bonus amounts are accumulated as with Triple PlayTime and awarded when the "PayTime" or "Triple PayTime" spots are hit.

Quick Pick Paytime includes a base game, which is a Bally S5500 upright slot machine, and a bonus game, which is constructed according to the teachings of the invention. The bonus game includes a bonus controller, which initiates a randomly selected one of about fifty scripted sequences to indicate a possible bonus award spot on a light board (over and above the pay table on the base game) when the bonus game is played. The bonus controller includes:

- a central processing unit (CPU); a vacuum fluorescent display (VFD) 98;
- a quick pick button to stop the light sequence through the bonus award spots (located similar to the "spin" button 96 in FIG. 2;
- a random number generator (RNG), which determines the bonus game outcome, i.e., the sequence of bonus award spot obtained; and
- firmware for controlling sound generation, the VFD, and the interface that initiates the bonus game.

The MCI 50 facilitates communication between the base game and the bonus controller.

The QuickPick secondary game is implemented as shown in FIG. 5, according to a preferred embodiment of the invention. In operation, the player plays the base game in block 1110 and is paid in block 114 according to the pay table 94 in that game. The base game has three reels 48, which—in each game-stop according to a random number generated for each reel. One of the reels includes an initiator symbol 95 (FIG. 3). The bonus controller 100 detects if that reel stops on the symbol in block 112. If it does, the bonus controller 100 initiates the bonus game in block 116 and delays the end of the base game. If no bonus symbol 95 is obtained on any one of the reels 48, then the game proceeds to block 114 and the jackpot award from symbols corresponding to paytable 94 payouts (if any) are awarded to the players credit meter 70 (FIG. 2).

The game incorporates a scripted bonus, meaning once the initiator symbol is hit then one of fifty scripts is selected in block 116 that take the player through the predetermined bonus sequence on the top box. Each script includes multiple steps and requires player interaction in order to advance to the next step in the sequence. The top box includes a diamond playing field with twelve different bonus spots (such as spots 102, 104), eight showing numerical values between 5 and 500, one "Lose ½" spot, one "Double" spot, a "PayTime" spot, and a "Triple PayTime" spot. When the player first hits the initiator symbol 95 on the base game, play proceeds to block 140, which initiates the first step in the scripted bonus sequence. The spots 102, 104 are flashed in random order in block 142 until the player hits the quick pick button 96. Upon detection of the stop button in block 144, the preselected bonus spot is lit in block 146. If the lit spot is a numerical value, then that amount is accumulated in block 148 in the VFD 98 and the player spins again. If a math function spot is detected in query block 150, then the math function is applied to the accumulated bonus total in block 152 and the bonus amount is updated in block 148. The "Double" spot doubles the amount in the VFD and the "Lose ½" cuts the accumulated bonus in half. The player accumulates awards, and the steps in the sequence advance in block 140, until either the PayTime or Triple PayTime spot is hit, as detected in query block 154, at which point the accumulated amount shown in the VFD (or triple that amount) is paid out to the player's credit meter in block 156. The sequence is then ended in block 158 and any jackpot award from the primary game is awarded in block 114.

An example of a QuickPick sequence is described below with reference to FIG. 3. Upon initiation of the bonus game, a script is generated in advance of play or selected from a plurality of scripts already stored in memory of the bonus game. The script includes 3 steps. In a first step, the "50 credit" space is the selected space. However, the player of the bonus game is unaware that the first bonus space in the sequence has been preselected. Instead, the player sees the bonus spaces flash at random such as the following: "5", "Double", "250", "Triple Paytime", "500". Seeing the top award (500) illuminated, the player quickly presses the stop button 96. The bonus game, detecting activation of the stop button, immediate lights up the "50" credit space to indicate the award. If the player were instead to press the stop button 96 after "Double" is illuminated, the "50 credit" space (instead of the randomly determined "250" space) would be lit to again show the selected bonus space. Again, since the player does not know in advance which space is to be lit, the player is given the misimpression that he or she had some control over the outcome of the game. The second step of the bonus sequence according to the script results in a "Lose ½" award and the third and final step in a "Paytime" award. The resulting bonus applied to the credit meter 70 once the bonus game is terminated is 25.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A method for operating a gaming machine under control of a processor operable in a bonus mode, the method comprising the steps of:

setting up under control of the processor a bonus game by defining a plurality of selection elements including an end-bonus spot, each selection element having a bonus game outcome associated therewith;

generating a bonus script, said script comprising a plural ity of steps in each of which a predetermined selection element is chosen, the last step of which is associated with an end-bonus spot;

storing the script in a memory;

retrieving the script from memory and operating the script on the gaming machine to select one or more selection elements in the bonus mode until encountering a selection element associated with an end-bonus spot, the selection element associated with the end-bonus spot causing the processor to end the bonus game;

determining under control of the processor a value of the selection elements selected in the bonus game; and awarding a bonus credit based on said value of the selection elements selected.

2. The method of claim 1, further comprising the step of operating successive steps of the script responsive to user interaction with the gaming machine.

3. The method of claim 2, the gaming machine including a spin button, wherein the user interaction with the gaming machine includes pressing the spin button.

4. The method of claim 1, further including the step of assigning various bonus game outcomes to the selection elements and accumulating the outcomes to yield a bonus credit value, whereby the outcomes include a payoff value assigned to each of a plurality of the selection elements, a math function assigned to at least one of the selection elements, and an end-bonus spot assigned to at least one of the selection elements.

5. The method of claim 4, wherein the math function includes a multiplicative value applied to the accumulated bonus credit value.

6. The method of claim 1 wherein the step of operating the script to select one or more of the selection elements includes:

for each step in the script, highlighting random ones of the selection elements; and then responsive to user interaction with the gaming machine, highlighting and selecting only the predetermined selection element associated with the current step of the bonus script.

7. The method of claim 6 wherein the gaming machine includes a stop button, the step of highlighting and selecting only the predetermined selection element occurs upon user interaction with the stop button.

8. A method of operating a gaming machine under control of a processor operable in a basic mode and a bonus mode, the method comprising the steps of:

selecting under control of the processor in said basic mode a basic game outcome among a plurality of possible basic game outcomes, the possible basic game outcomes including a start-bonus outcome;

shifting operation of the processor from said basic mode to the bonus mode in response to the selection of the start-bonus outcome, otherwise, continuing operation of the processor in the basic mode;

setting up under control of the processor a bonus game by defining a plurality of selection elements including at least one end-bonus spot;

assigning various bonus game outcomes to the selection elements;

generating a bonus script, said script comprising a plurality of steps in each of which a predetermined selection element is chosen, the last step of which is associated with an end-bonus spot;

storing the script in a memory;

retrieving the script from memory and operating the script on the gaming machine to select one or more selection elements in the bonus mode until encountering a selection element associated with an end-bonus spot, the selection element associated with the end-bonus spot causing the processor to end the bonus game;

determining under control of the processor a value of the selection elements selected in the bonus game; and awarding a bonus credit based on said value of the selection elements selected.

9. The method of claim 8 wherein die basic game comprises a slot machine including a number of reels each including a plurality of displayable symbols, the step of selecting a basic game outcome comprising the steps of:

randomly selecting a combination of said symbols; and displaying said combination of symbols.

10. The method of claim 9, wherein the start-bonus outcome is characterized by the display of a designated start-bonus game symbol on each of the reels.

11. The method of claim 8, further including the steps of:

generating a script prior to the step of selecting the selection elements, said script predetermining the order and selection of the selection elements; and executing the script during the step of selecting the selection elements.

12. A gaming machine comprising:

a processor for controlling game play in a bonus mode, the processor operating in a bonus mode to set up a bonus game by defining a plurality of selection elements;

means for assigning under control of the processor various bonus game outcomes to the selection elements;

means for generating a bonus script, said script comprising a plurality of steps in each of which a predetermined selection element is chosen, the last step of which is associated with an end-bonus spot;

means for storing the script in a memory;

means for retrieving the script from memory and operating the script on the gaming machine to select one or more selection elements in the bonus mode until encountering a selection element associated with an end-bonus spot, the selection element associated with the end-bonus spot causing the processor to end the bonus game;

valuation means for determining under control of the processor a value of the selection elements selected in the bonus game; and bonus credit means for awarding a bonus credit based on said value of the selection elements selected.

13. The gaming machine of claim 12 wherein the valuation means includes means for summing the payoff values of the selection elements selected according to the script.

14. The gaming machine of claim 12, further including a stop button active to receive user input during each step of the script, the stop button ending the step of the bonus script.

15. The gaming machine of claim 12, further including a script generation means for generating upon the start of the bonus mode an order in which the selection elements are selected during the bonus game.

16. The gaming machine of claim 15, wherein the script generation means includes a memory in which a plurality of scripts are stored, a selected one of which is used for the bonus game.

17. The gaming machine of claim 12, further including means for highlighting the random ones of the selection elements during each step of the bonus script and, responsive to user interaction with the gaming machine, only the predetermined selection value to be highlighted.

* * * * *

UNITED STATES PATENT AND TRADEMARK OFFICE

CERTIFICATE OF CORRECTION

PATENT NO. : 7,033,272 B1
APPLICATION NO. : 10/120213
DATED : April 25, 2006
INVENTOR(S) : Shannon Mason It is certified that error appears in the above-identified patent and that said Letters Patent is hereby corrected as shown below:

At column 10, line 33, please replace “wherein die basic” with -- wherein the basic --

Signed and Sealed this

Fifth Day of September, 2006

JON W. DUDAS
*Director of the United States Patent and Trademark Office*